US006062134A

United States Patent [19]

Eitel et al.

[11] Patent Number: 6,062,134

[45] Date of Patent: May 16, 2000

[54] EMBOSSING CYLINDER

[75] Inventors: Johann Emil Eitel, Thungen; Johannes Georg Schaede, Wurzburg, both of Germany

[73] Assignee: De la Rue Giori S.A., Lausanne, Switzerland

[21] Appl. No.: 09/155,027

[22] PCT Filed: Mar. 20, 1997

[86] PCT No.: PCT/DE97/00569

§ 371 Date: Sep. 17, 1998

§ 102(e) Date: Sep. 17, 1998

[87] PCT Pub. No.: WO97/36756

PCT Pub. Date: Oct. 9, 1997

[30] Foreign Application Priority Data

Mar. 28, 1996 [DE] Germany ..... 196 12 314

[51] Int. Cl.[7] ..... B31F 1/07

[52] U.S. Cl. ..... 101/28; 101/16; 101/22; 400/134.2

[58] Field of Search ..... 101/16, 28–31, 101/22, 23, 25, 8, 9, 24, 18; 400/129, 134.2, 134.4

[56] References Cited

U.S. PATENT DOCUMENTS

| | | | |
|---|---|---|---|
| 2,736,257 | 2/1956 | Stephenson | 101/8 |
| 4,580,492 | 4/1986 | Troyan et al. | 101/6 |
| 5,069,122 | 12/1991 | Kaufman et al. | 101/9 |

*Primary Examiner*—Ren Yan
*Assistant Examiner*—Dave A Ghatt
*Attorney, Agent, or Firm*—Kane, Dalsimer, Sullivan and Levy, LLP

[57] ABSTRACT

An embossing cylinder for embossing a foil comprising a plurality of stamping dies, where the stamping dies are mounted on the cylinder through adjustable means allowing each of the dies to be adjusted in the axial direction and in the circumferential direction of the embossing cylinder.

4 Claims, 3 Drawing Sheets

EMBOSSING CYLINDER

The invention relates to an embossing cylinder according to the preamble of claim 1.

The object of the invention is to provide an embossing cylinder.

Preferably, the stamping dies can be changed individually. With this possibility, one can avoid to change an expensive stamping ring with a great number of stamping dies. It is particularly advantageous that the stamping dies can be adjusted individually. Hence the stamping dies can be individually adapted to the deformation occurring on the material to be embossed, for example sheets of paper. This adjustment possibility of the stamping dies is particularly advantageous with hot stamping cylinders, with which a sample of a hot stamping foil is applied on a paper sheet. With these paper sheets, there is a particularly high risk that a deformation appears on the paper due to high mechanical pressure load with the simultaneous influence of heat.

A dovetail-shaped guiding for the stamping dies allows an easy adjustment or exchange and is simple and inexpensive to build.

The embossing cylinder according to the invention is represented in the drawings and is described in more detail in the following:

Figure 1:
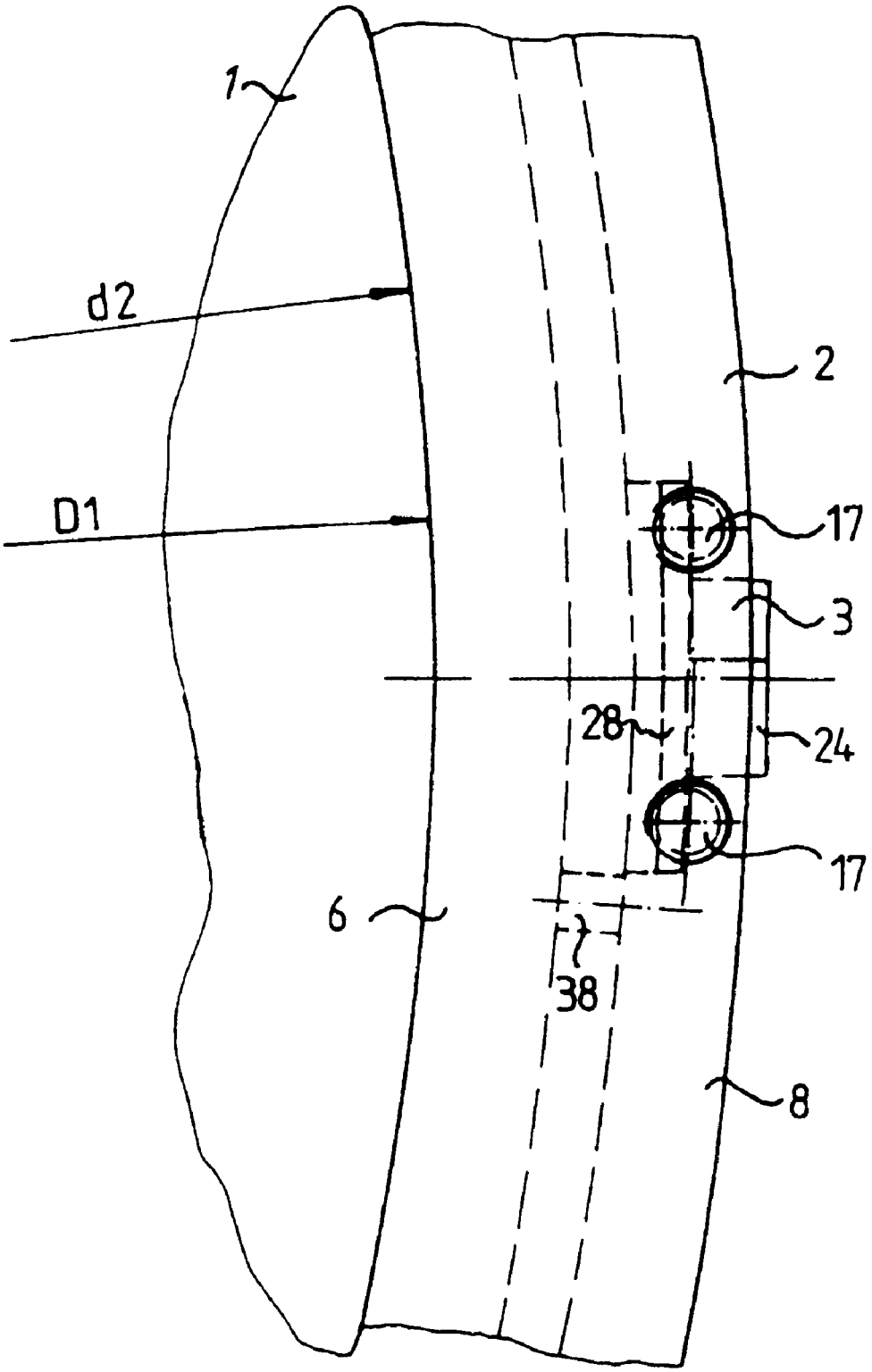
FIG. 1 shows a schematical side view of the embossing cylinder.
Figure 2:
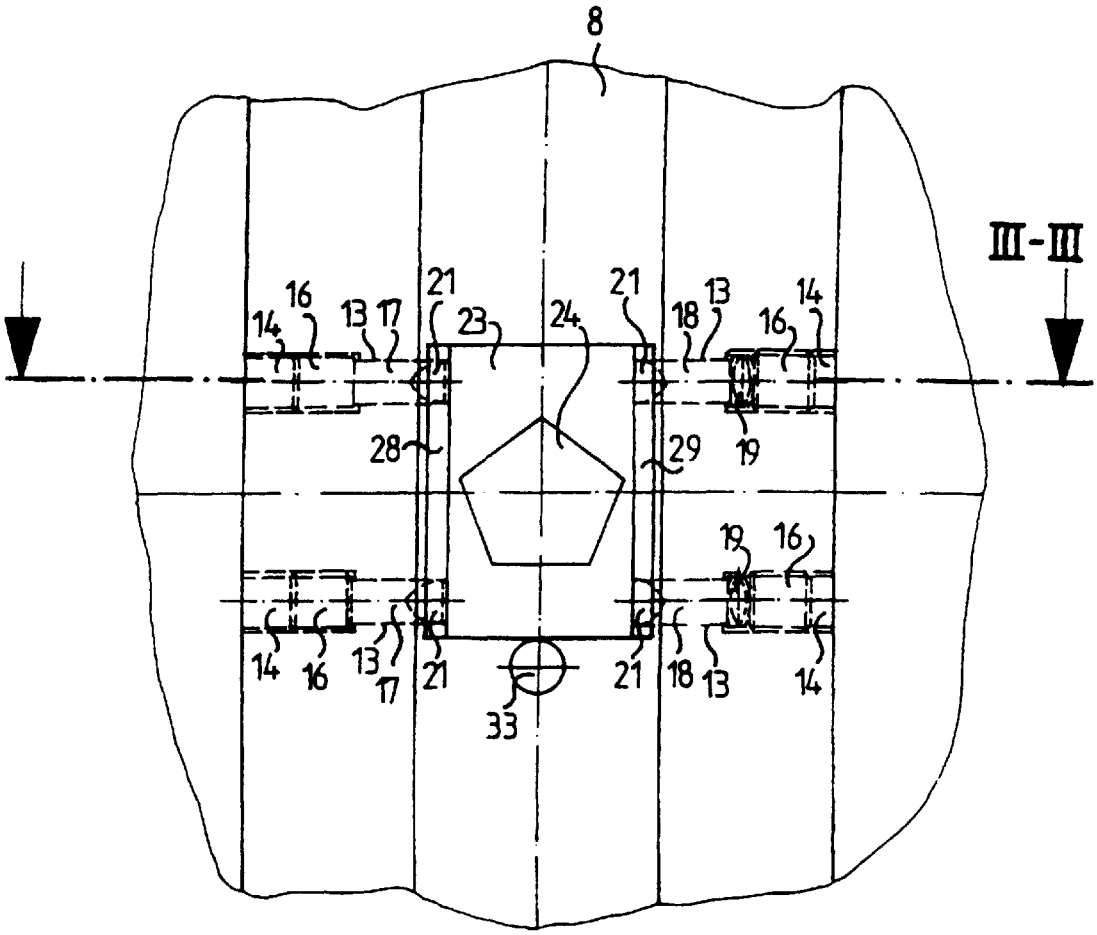
FIG. 2 shows a schematical top view of a cut-out if the embossing cylinder.
Figure 3:
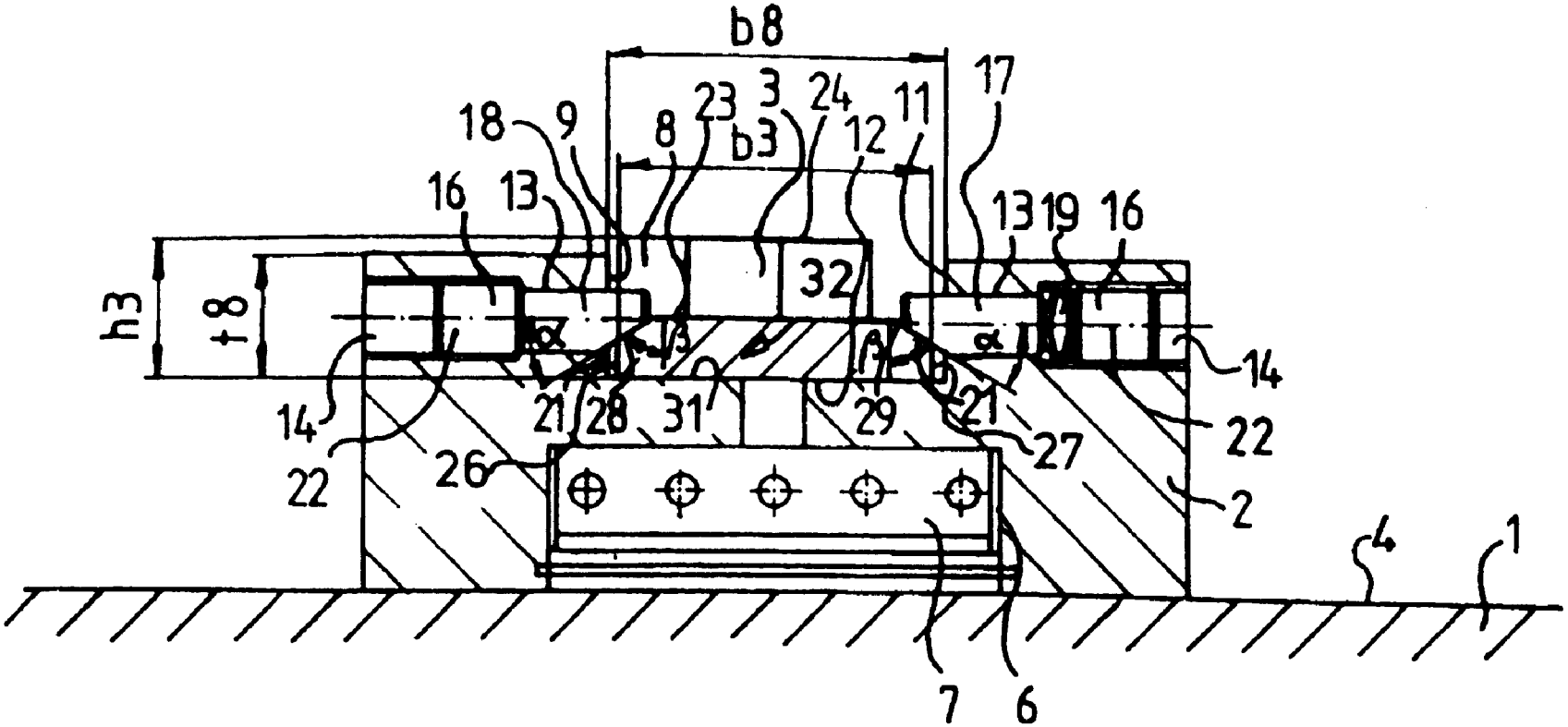
FIG. 3 shows a schematical cut through an stamping die of an embossing cylinder.

An embossing cylinder 1, in particular a hot stamping cylinder 1 for a rotational hot stamping of samples of a foil on a paper sheet or a paper web in an stamping machine is provided with at least a supporting ring 2 for supporting stamping dies 3. In the axial direction of the hot embossing cylinder 1, a plurality of said supporting rings 2 can be placed on the hot embossing cylinder one next to the other. The supporting ring 2 comprises, in cross section, a H-shaped profile extending along the circumferential direction of the hot embossing cylinder 1. An inner diameter d2, for example d2=550 mm, of the supporting ring 2 corresponds to an outer diameter D1, for example D1=600 mm, of the hot embossing cylinder, so that the supporting ring 2 is movable, when the hot embossing cylinder 1 is not heated.

In a first U-shaped groove 6 of the supporting ring 2, which is turned towards the circumferential surface 4 of the hot embossing cylinder 1, electrically heated heating elements 7 are placed. A second U-shaped groove 8 of the supporting ring 2, which is directed towards outside, is limited by two parallel side walls 9, 11 facing each other and by a ground surface 12. This groove 8 comprises in its cross-section a depth t8, for example t8=12,5 mm, and a width b8, for example b8=33 mm, and is, in the present embodiment, formed in an endless rotating manner. In both side walls 9, 11 of said groove 8, a plurality of holes 13 are drilled, which are parallel to the axis of the hot embossing cylinder and perpendicular through the side walls 9, 11, having a diameter d13, for example d13=6 mm. Each one of said holes 13 is extended by a tapping 14. A screw 16 is screwed in the tapping 14. The screws 16 in the left side wall 9 press directly against a first end of a thrust piece 17, for example a pin 17. In the right side wall 11, there is each time a spring 19 between the screw 16 and a thrust piece 18, for example a pin 18, said spring having for example the shape of a stack of disk springs. An end of the pin 17, 18 projects beyond the U-shaped groove 8 wedge-shaped, for example comprises an obliquely extending clamping surface 21. This clamping surface 21 forms an angle alpha, for example alpha=45°, with a longitudinal axis 22 of pin 17, 18. Instead of having clamping surfaces 21 build in such a manner, other shapes are possible, such as for example a conical-shaped end of the pins 17,18.

In the U-shaped groove 8, there is at least one stamping die 3. This stamping die 3 has a height h3, for example h3=12,5 mm, and a width b3, for example b3=30 mm. The height h3 of the stamping die 3 is larger than the depth t8 of the U-shaped groove 8 and the width b3 of the stamping die is in the exemplary embodiment smaller than the width b8 of the U-shaped groove 8. It is also possible that the height h3 and the depth t3 are equal. On its radial external surface 23, the stamping die 3 comprises one or several elevated transfer surface(s) 24. This transfer surface 24 is formed as an equilateral pentagon. On both side surfaces 26, 27, in the circumferential direction of the supporting ring 2, clamping surfaces 28, 29 are arranged which match a curvature of the supporting ring 2. These clamping surfaces 28, 29 curved in the circumferential direction form with the corresponding side surfaces 26, 27 an angle beta, for example beta=45°. A ground surface 31 of the stamping die 3 is applied against the ground surface 12 of the U-shaped groove 8. This ground surface 31 is adjusted to the curvature of the ground surface 12 of the U-shaped groove 8 of the stamping die and thus slightly curved. Through the arrangement of both axially symmetrical clamping surfaces 28, 29 and of the ground surface 31, a cross section of the stamping die is approximately dovetailed. Hence the stamping die 3 comprises a dovetailed guide 32 which is curved in a manner corresponding to the curvature of the supporting ring 2. In the present exemplary embodiment, four thrust pieces 17, 18 are provided, which cooperate with the clamping surfaces 28, 29 of this dovetailed guide 32. Both thrust pieces 18, which are arranged in the left side wall 9 with no springs, act as adjustable stops. Both thrust pieces 17, arranged with springs in the right side wall 11, press the stamping die 3 against both thrust pieces 18 of the Left side. A force component in the radial direction is thus created by the clamping surfaces 28, 29 and the thrust pieces 17, 18 arranged with the angles alpha and beta, said force pressing the stamping die 3 against the ground surface 12 of the U-shaped groove 8. In order to align the stamping die 3 in the circumferential direction, a hole 33 is provided for example on the ground surface 12 of the U-shaped groove 8, in which a pin may be introduced to be used as a stop. It is also possible to provide the supporting ring with a numerical graduation in the circumferential direction.

For alignment in the circumferential direction, both right screws 16 are unscrewed until the springs 19 are released. The stamping die can then be moved to the desired position in the circumferential direction. Both screws 16 are then screwed in again, until the springs 19 exert a given initial stress on the thrust pieces 17, 18. The stamping die 3 is thus pressed against the thrust pieces 17, 18 of the opposite side. If the stamping die 3 has to be displaced in the axial direction of the hot embossing cylinder, both screws 16 of the thrust pieces with no springs are equally turned. If need be, the initial stress of the springs 19 of the thrust pieces 18 on the opposite side is readjusted.

List of reference symbols

1 embossing cylinder, hot embossing cylinder
2 supporting ring
3 stamping die

4 circumferential surface (1)
5 -
6 groove,U-shaped (2)
7 heating element
8 groove, U-shaped (2)
9 side wall (8)
10 -
11 side wall (8)
12 ground surface (8)
13 hole
14 tapping
15 -
16 screw
17 pin, thrust piece
18 pin, thrust piece
19 spring
20 -
21 clamping surface (17;18)
22 longitudinal axis (17;18)
23 surface (3)
24 transfer surface (3)
25 -
26 side surface (3)
27 side surface (3)
28 clamping surface (3)
29 clamping surface (3)
30 -
31 ground surface
32 guide
33 hole
b3 width of the stamping die
b8 width of the groove (8)
D1 outer diameter of the embossing cylinder
d2 inner diameter of the supporting ring
h3 height stamping die
t8 depth of the groove
alpha angle
beta angle

We claim:

1. Embossing cylinder for embossing a foil comprising a plurality of stamping dies, wherein said stamping dies are mounted on said cylinder through adjustable means allowing each of said dies to be adjusted in the axial direction and in the circumferential direction of said embossing cylinder without any adjustment from surrounding dies.

2. Embossing cylinder as claimed in claim 1, wherein said cylinder is a hot embossing cylinder comprising heating elements (7) and said stamping dies are heated through said heating elements.

3. Embossing cylinder as claimed in claim 1, wherein said adjustable means comprise a dovetailed guide part (32) of the stamping die with at least two clamping surfaces (28,29) in cooperation with thrust pieces (17,18) mounted on said cylinder in order to adjust the position of said die in the axial direction of said cylinder.

4. Embossing cylinder as claimed in claim 3, wherein said adjustable means additionally comprise stop means (33) for aligning said dies in the circumferential direction of said cylinder.

* * * * *